US006651642B1

(12) United States Patent
Powers

(10) Patent No.: US 6,651,642 B1
(45) Date of Patent: Nov. 25, 2003

(54) TRIGGER SHOE

(76) Inventor: Michael Ivan Powers, 3080 Upper Fords Creek Rd., Orofino, ID (US) 83544

( * ) Notice: Subject to any disclaimer, the term of this patent is extended or adjusted under 35 U.S.C. 154(b) by 0 days.

(21) Appl. No.: 10/187,145

(22) Filed: Jun. 28, 2002

(51) Int. Cl.[7] ..... F41B 5/18
(52) U.S. Cl. ..... 124/35.2; 124/31; 42/69.01
(58) Field of Search ..... 42/69.01; 124/31, 124/35.2

(56) References Cited

U.S. PATENT DOCUMENTS

| | | | | |
|---|---|---|---|---|
| 2,920,413 | A | * | 1/1960 | Marhefka et al. |
| 3,937,206 | A | | 2/1976 | Wilson |
| 3,952,720 | A | | 4/1976 | Wilson |
| 4,022,181 | A | | 5/1977 | Fletcher |
| 4,041,926 | A | | 8/1977 | Troncoso, Jr. |
| 4,083,348 | A | | 4/1978 | Fletcher |
| 4,132,215 | A | | 1/1979 | Burton |
| 4,156,417 | A | | 5/1979 | Fletcher |
| 4,539,968 | A | | 9/1985 | Garvison |
| 4,667,429 | A | * | 5/1987 | Perazzi |
| 4,672,945 | A | | 6/1987 | Carlton |
| 4,791,908 | A | | 12/1988 | Pellis |
| 4,877,009 | A | | 10/1989 | Becker |
| 4,949,698 | A | | 8/1990 | Burnham |
| 5,020,508 | A | | 6/1991 | Greene, Jr. |
| 5,439,231 | A | | 8/1995 | Roberts et al. |
| 5,505,187 | A | | 4/1996 | Troncoso et al. |
| 5,546,924 | A | | 8/1996 | Todd |
| 5,845,628 | A | | 12/1998 | Pellerite |
| 5,857,452 | A | | 1/1999 | Troncoso |
| 6,032,661 | A | | 3/2000 | Goff et al. |
| 6,205,991 | B1 | * | 3/2001 | Summers et al. ..... 124/35.2 |
| 6,302,093 | B1 | | 10/2001 | Holland |
| 6,367,465 | B1 | * | 4/2002 | Buccieri, Jr. ..... 124/31 |

* cited by examiner

*Primary Examiner*—John A. Ricci
(74) *Attorney, Agent, or Firm*—Law Office of Duncan Palmatier

(57) ABSTRACT

The invention discloses an adjustable trigger shoe for the trigger of an archery bowstring release mechanism. The adjustable trigger shoe can be secured to the release mechanism trigger in a nearly infinite range of positions to provide exactly the right feel to the archer. In alternative disclosed embodiments, the trigger shoe also has a gripping surface, formed of ridges or knurling, and sharp or rounded trigger edges, to provide additional sensitivity to the archer.

19 Claims, 3 Drawing Sheets

TRIGGER SHOE

BACKGROUND OF THE INVENTION

1. Field of the Invention

Accuracy in archery is aided by devices that assist in drawing and releasing the bowstring. These bowstring release mechanisms often have triggers. Trigger shape and position can affect accuracy. The disclosed invention is an adjustable trigger shoe to conform the trigger to the archer's finger. One specifically disclosed embodiment shows a trigger shoe that adjustably attaches over the end of the trigger of a conventional archery bowstring release mechanism. Another specifically disclosed embodiment shows a trigger shoe that adjustably attaches along the length of the trigger of a conventional archery bowstring release mechanism, allowing additional adjustability.

2. Discussion of Prior Art

Trigger activated archery bowstring release mechanisms are known in the prior art. Some of these mechanisms include devices for trigger adjustment. In U.S. Pat. No. 3,952,720, Wilson teaches a trigger adjustment device to adjust the amount of force necessary to pull the trigger, and also to adjust the amount of movement of the trigger necessary to release the bowstring.

In U.S. Pat. No. 5,546,924, Todd teaches a trigger adjustment device to adjust the distance the trigger must travel before release, partly to prevent premature release due to a large bowstring force.

Whether hunting for game, or competing in an archery competition, improved contact between the trigger and the archer's trigger finger provides better trigger control and a more accurate shot. While prior art trigger devices permit adjustment of the trigger pull and travel distance for sensitivity, they do not permit the trigger to be rotated, tilted, or raised and lowered. The prior art adjustable trigger devices do not permit the trigger to be adjusted to the position or shape of the archer's trigger finger, to the shape of the archer's hand, or simply for the archer's comfort or other ergonomic factors. Thus with prior art adjustable trigger devices, the archer must accept less than optimal trigger position, and less control over bowstring release.

SUMMARY OF THE INVENTION

It is one object of the present invention to provide a trigger shoe that is attachable and detachable from existing archery bowstring release mechanisms. It is another object of the present invention to provide a trigger shoe that may be rotated, tilted, raised and lowered, and fixed in any of these positions. It is another object of the present invention to provide a shape of the trigger shoe to suit the comfort and preferences of the archer.

In accordance with these objectives, the present invention provides a trigger shoe that may be adjustably attached to archery bowstring release mechanisms for optimal trigger position and optimal contact between the trigger and the archer's trigger finger. In one preferred embodiment, a trigger shoe comprises a body, a chamber, and four set screws threaded into the body to secure the trigger inside the chamber. The trigger shoe may be rotated and tilted and attached to the trigger in any such position. The surface of the body may be smooth, ridged, knurled or rounded to suit the preference of the archer.

In another preferred embodiment, a trigger shoe comprises a body, a chamber extending completely through the body, and four set screws threaded into the body to secure the trigger inside the chamber. The trigger shoe may be rotated, tilted, raised and lowered, and attached to the trigger in any such position. The surface of the body may be smooth, ridged, knurled or rounded to suit the preference of the archer.

DESCRIPTION

Figure 1:
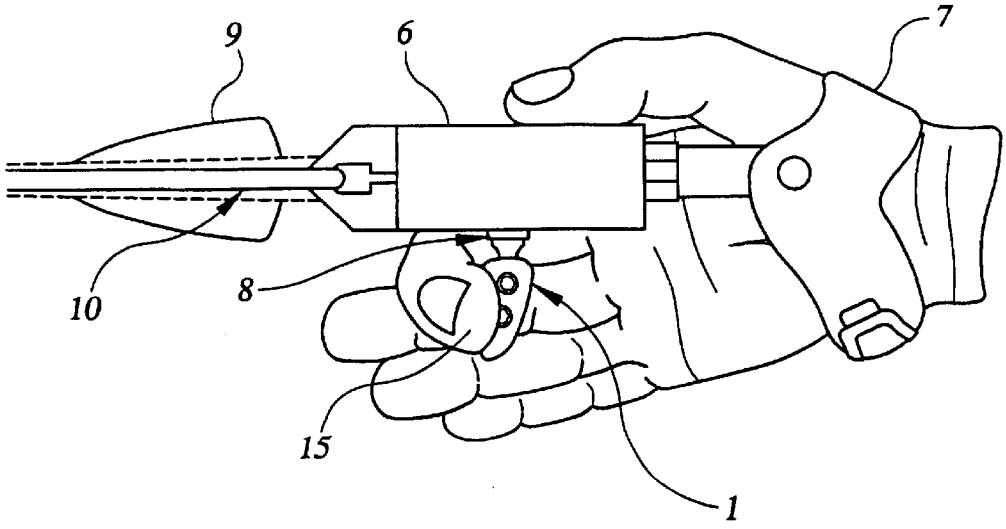
FIG. 1 is a side view of use of an archery bowstring release mechanism, showing the present invention attached to the trigger.
Figure 2:
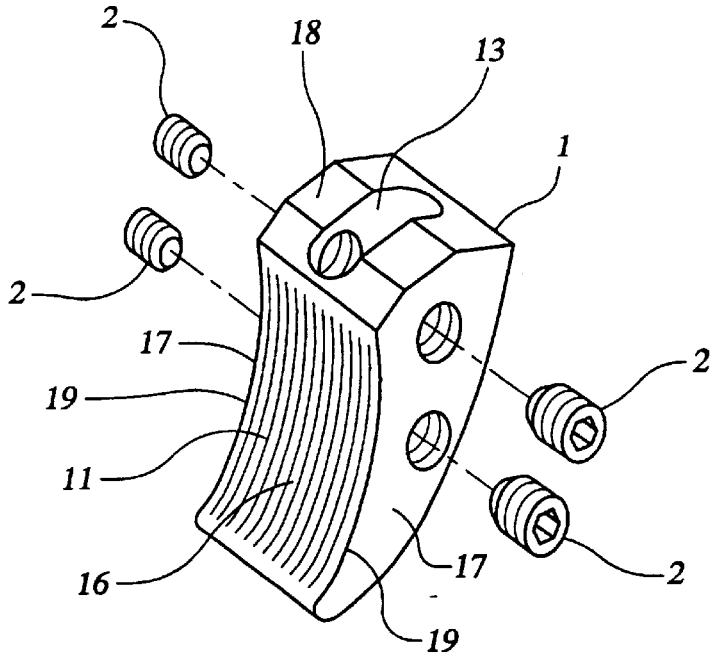
FIG. 2 is an exploded three-quarter view of the trigger shoe, with an alternate embodiment ridged surface.
Figure 3:
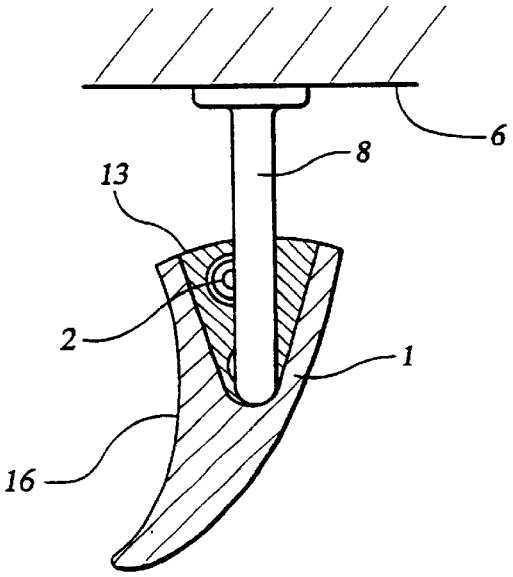
FIG. 3 is a cut-away side view of the trigger shoe attached to a release trigger.

FIG. 1 shows a side view of a conventional bowstring release mechanism (6) attached to an archer's hand with a wrist strap (7). This view is looking up from the bottom of the bow, and the bowstring (10) can be seen entering the jaw of the release mechanism (6). The arrow (9) extends away from the release mechanism (6). The present invention trigger shoe (1) is secured to the trigger (8) of the release mechanism (6) by set screws (2, as seen in FIG. 2). One set screw (2) is sufficient to secure the trigger shoe (1) to the trigger (8) by forcing the trigger (8) against the side of a chamber (13, as seen in FIGS. 2 and 3), but additional screws (2) provide increased mechanical security. The trigger shoe (1) may be raised, lowered, tilted and rotated, and secured in any such position to conform to the shape of the archer's hand and trigger-finger (18) or to suit the archer's preferences.

Figure 5:
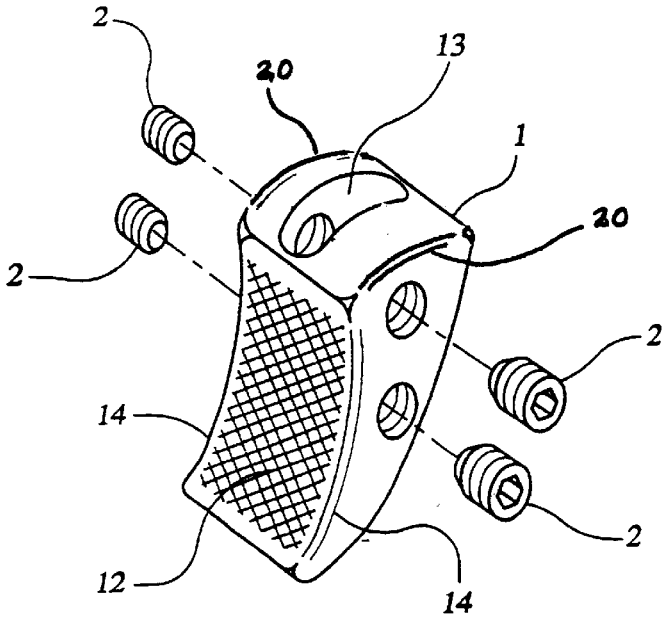
FIG. 5 is an exploded three-quarter view of the trigger shoe, with an alternate embodiment knurled surface and with rounded edges.

FIG. 2 shows an exploded three quarter view of the trigger shoe. The trigger shoe (1) has a trigger face (16) which is formed in a traditional trigger shape to conform to the archer's trigger finger (18, as seen in FIG. 1). The trigger face (16) may be smooth or it may be formed with a gripping surface. The gripping surface provides additional feel and sensitivity to the archer's trigger finger (18). Examples of gripping surfaces are shown as ridges (11) in FIG. 2 or a knurled surface (12) in FIG. 5. The edges (19) between the trigger face (16) and shoe's sides (17) can be sharp, as shown in FIG. 2, or rounded (14), as shown in FIG. 5, to suit the archer's preference. Similarly, the top edges (20) may also be rounded to suit the archer's preferences. The trigger shoe (1) may be manufactured in many conventional ways, such as machining or molding, and may be made of many conventional materials, such as metals or plastics. The chamber (13) is formed in the trigger shoe (1) and opens at the top (18). As seen in FIG. 3, the bowstring release trigger (8) extends into the chamber (13). The shape of the chamber (13) allows the trigger shoe (1) to be pivoted forward and back, so that the trigger (8) contacts the archer's trigger finger (18) at just the right spot. In addition, it can be seen that the trigger shoe (1) can be rotated about the trigger (8), thereby providing additional adjustability. It can also be seen that the embodiment shown in FIG. 3 allows some adjustment up and down; that is, the trigger shoe (1) can be raised or lowered on the trigger (8). Set screws (2) secure the trigger shoe (1) to the trigger (8), once the archer has found just the right position.

Figure 4:
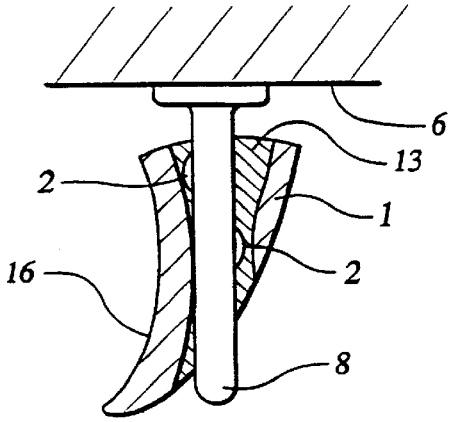
FIG. 4 is a cut-away side view of one preferred embodiment of an alternate embodiment of the trigger shoe attached to a release trigger.

FIG. 4 shows an alternate embodiment of the present invention. The chamber (13) extends all the way through the trigger shoe (1). In this embodiment, additional adjustment is provided by allowing the trigger shoe (1) to be mounted farther up the trigger (8).

Figure 6:
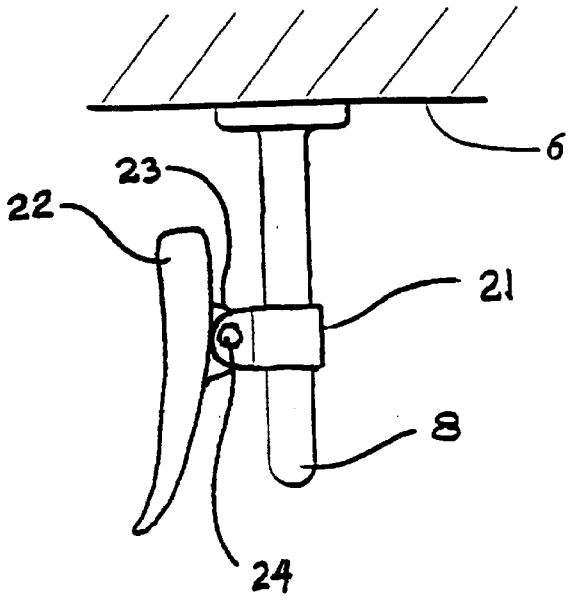
FIG. 6 is a side view of an alternative embodiment of the disclosed trigger shoe invention.
Figure 8:
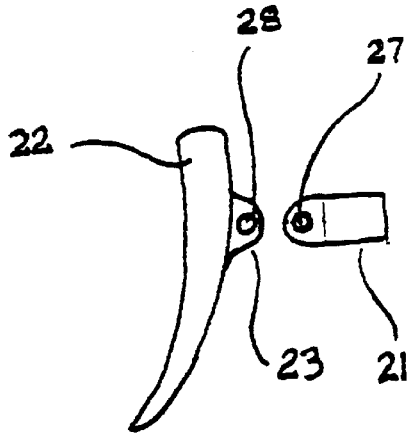
FIG. 8 is a side, exploded view of an alternative embodiment of the disclosed trigger shoe invention.
Figure 7:
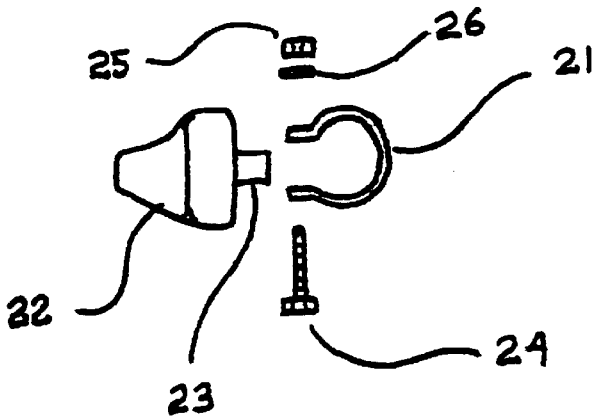
FIG. 7 is a top, exploded view of an alternative embodiment of the disclosed trigger shoe invention.

FIGS. 6 through 8 shows an alternate embodiment of the present invention. A trigger shoe body (22) mounts to the trigger (8) of a conventional bowstring release mechanism (6) by a clamp (21). A mounting post (23) on the back side of the shoe (22) has a bore (28). The clamp (21) has a corresponding bore (27), and a bolt passes through the clamp's bore (27) and shoe's bore (28), and a washer (26) and nut (25) secure the clamp (21) to the shoe (22). It can be seen that the shoe (22) may be mounted in any radial position about the trigger (8), and that the shoe may be pivoted on the mounting post (23), and that the shoe (22) may be adjusted up and down on the trigger (8).

Use of the trigger shoe permits virtually infinite adjustment to conform to the archer's trigger finger and hand, and to suit the archer's preferences and other ergonomic factors. This ensures optimal contact between the archer's finger and the trigger providing the greatest sensitivity and control for improved accuracy. Different surface textures are but examples of variations for the individual archer consistent with the principles of the present invention that will be understood by one skilled in the art, and which are considered to be within the scope of the present invention.

What I claim is:

1. A trigger shoe for the trigger of an archery bowstring release mechanism, comprising:

a body having a trigger face and a top, and a chamber within the body, an opening at the top communicating with the chamber, and at least one threaded bore opening into the chamber, a set screw threadedly received by the bore, to secure the body to the trigger of the archery bowstring release mechanism.

2. The trigger shoe of claim 1 further comprising a gripping surface on the trigger face.

3. The trigger shoe of claim 2 wherein the gripping surface comprises ridges.

4. The trigger shoe of claim 2 wherein the gripping surface comprises knurling.

5. The trigger shoe of claim 1, wherein the trigger face extends from the top to a bottom and has at least one edge running along the face from the top to the bottom.

6. The trigger shoe of claim 5, wherein the edge is sharp.

7. The trigger shoe of claim 5, wherein the edge is rounded.

8. The trigger shoe of claim 1, wherein body further comprises a back surface, and wherein the chamber extends through the body, from the opening at the top to a bottom opening in the back surface.

9. A trigger shoe for the trigger of an archery bowstring release mechanism, comprising:

a body having a means for adjustably attaching the shoe to the trigger of the release mechanism.

10. The trigger shoe of claim 9, wherein the shoe has a trigger face, and wherein the face further comprises a means for gripping.

11. The trigger shoe of claim 9, wherein the shoe has a top and a bottom and a trigger face and an edge extending along the face between the top and the bottom.

12. The trigger shoe of claim 11, wherein the edge is sharp.

13. The trigger shoe of claim 11, wherein the edge is rounded.

14. A trigger shoe for the trigger of an archery bowstring release mechanism, comprising:

a body having a curved trigger face, a curved back surface, a top surface, a pointed bottom, sides between the top surface and the bottom and running the length of the face, a chamber, to receive the trigger, within the shoe body and communicating with an opening in the top of the body, at least one threaded bore in at least one of the sides of the body, wherein the threaded bore communicates with the chamber, a set screw, threadedly received by the bore, to secure the body to the trigger.

15. The trigger shoe of claim 14, wherein the trigger face further comprises a gripping surface.

16. The trigger shoe of claim 15, wherein the gripping surface comprises ridges.

17. The trigger shoe of claim 15, wherein the gripping surface comprises knurling.

18. The trigger shoe of claim 14, wherein the edge is rounded.

19. The trigger shoe of claim 14, wherein a top edge between at least one of the sides and the top surface is rounded.

* * * * *